US005595300A

United States Patent [19]

Paik et al.

[11] Patent Number: 5,595,300

[45] Date of Patent: Jan. 21, 1997

[54] APPARATUS FOR HOLDING AND DISPENSING FLAT ARTICLES

[75] Inventors: Harry S. Paik, Sacramento; Kotaro Shimogori, Venice, both of Calif.

[73] Assignee: Infopak International, Inc., Seattle, Wash.

[21] Appl. No.: 523,717

[22] Filed: Sep. 5, 1995

[51] Int. Cl.[6] ..... B65D 85/62; B65D 43/16

[52] U.S. Cl. ..... 206/449; 206/470; 220/315; 220/324; 248/206.3; 248/230.8

[58] Field of Search ..... 206/449, 470, 206/806, 469, 455; 220/339, 315, 324; 248/206.3, 230.8

[56] References Cited

U.S. PATENT DOCUMENTS

| | | | |
|---|---|---|---|
| 1,739,801 | 12/1929 | Pitts | 248/206.3 X |
| 3,371,829 | 3/1968 | Phillips . | |
| 3,463,309 | 8/1969 | Szostek | 206/470 |
| 3,463,436 | 8/1969 | Foster, Jr. | 248/230.8 X |
| 3,767,110 | 10/1973 | Congleton | 220/324 X |
| 4,005,776 | 2/1977 | Seeley . | |
| 4,322,001 | 3/1982 | Hurley | 206/449 |
| 4,383,607 | 5/1983 | Lordahl et al. . | |
| 4,629,070 | 12/1986 | Roberg . | |
| 4,807,806 | 2/1989 | Neiman . | |
| 4,884,718 | 12/1989 | Leahy | 220/339 |
| 4,930,627 | 6/1990 | Borst et al. | 206/470 X |
| 4,986,438 | 1/1991 | Borst | 220/315 |
| 5,012,927 | 5/1991 | Borst | 206/470 |
| 5,038,936 | 8/1991 | Borst . | |
| 5,060,794 | 10/1991 | Linn et al. . | |
| 5,090,568 | 2/1992 | Tse . | |
| 5,121,835 | 6/1992 | Grupe | 206/470 X |
| 5,147,035 | 9/1992 | Hartman | 206/470 X |
| 5,209,354 | 5/1993 | Thornhill et al. . | |
| 5,267,643 | 12/1993 | Scribner . | |

*Primary Examiner*—Bryon P. Gehman
*Attorney, Agent, or Firm*—Thomas R. Lampe

[57] ABSTRACT

Apparatus for holding and dispensing flat articles such as flyers or brochures includes a receptacle back member formed of molded plastic sheet material and a receptacle front member formed of molded plastic sheet material. The back and front members are connectable and the front member may be opened or closed relative to the back member. A cover member is hingedly secured to the receptacle back member at the upper end of the receptacle back wall to selectively cover the opening and to resist movement of the front member away from the back member when the cover member is closed.

11 Claims, 4 Drawing Sheets

APPARATUS FOR HOLDING AND DISPENSING FLAT ARTICLES

TECHNICAL FIELD

This invention relates to an apparatus for holding and dispensing flat articles. The apparatus has particular application to the display and dispensing of printed matter in the form of flyers, brochures, and the like.

BACKGROUND ART

It is a well known practice to utilize holders of various types to contain a plurality of flyers or other forms of printed matter for access by the public. Such devices are commonly utilized, for example, in the real estate business. Such holders are often employed outdoors with consequent exposure to the elements.

Typically, such devices are relatively expensive; however, attempts have been made to lower the cost of printed matter holders. U.S. Pat. No. 5,267,643, issued December, 1993, for example, discloses an outdoor plastic information dispenser which utilizes a transparent plastic bag, preferably of clear, soft, vinyl, for the display of the informational contents. A combination hanger/flap formed from a single piece of corrugated polypropylene plastic is incorporated in the structure to provide support and stability. The hanger/flap is attached to the bag by fastening grommets.

The following patents relate to various packaging assemblies, including assemblies at least partially formed of molded plastic, and are believed to be representative of the general state of the prior art in that field: U.S. Pat. No. 4,383,607, issued May 17, 1983, U.S. Pat. No. 5,038,936, issued Aug. 13, 1991, U.S. Pat. No. 4,807,806, issued Feb. 28, 1989, U.S. Pat. No. 6,209,354, issued May 11, 1993, U.S. Pat. No. 3,371,829, issued Mar. 5, 1968, U.S. Pat. No. 4,005,776, issued Feb. 1, 1977, U.S. Pat. No. 5,090,568, issued Feb. 25, 1992, U.S. Pat. No. 5,060,794, issued Oct. 29, 1991, and U.S. Pat. No. 4,629,070, issued Dec. 16, 1986.

Such prior art devices are not intended for (nor are they particularly appropriate for) display and dispensing of flyers and similar flat articles.

DISCLOSURE OF INVENTION

The apparatus of the present invention is of relatively simple, inexpensive construction and provides for the storage and dispensing of flat articles therefrom with ease. The apparatus also affords superior protection of the contents thereof from the elements. The structure of the apparatus is light weight and relatively strong and rigid to prevent damage to the apparatus and to the articles within the interior thereof.

The apparatus of the present invention is for holding and dispensing flat articles. The apparatus includes a receptacle back member having upper and lower ends and a receptacle front member having upper and lower ends and defining an opening at the upper end thereof.

The receptacle front member is connectable to the receptacle back member and is movable between an open position and a closed position relative to the receptacle back member. The receptacle back member and the receptacle front member define a receptacle interior for accommodating a plurality of flat articles when the receptacle front member is in the closed position.

Latch means is provided for releasably latching the receptacle front member to the receptacle back member with the receptacle front member in its closed position.

A cover member is hingedly secured to the receptacle back member at the upper end of the receptacle back member and movable between a first position wherein the cover member covers the opening defined by the receptacle front member and resists movement of the receptacle front member away from the receptacle back member when the receptacle front member is in the closed position and a second position wherein the cover exposes the opening allowing manual access to flat articles in the receptacle interior and allowing movement of the receptacle front member away from the receptacle back member.

Support means is provided for supporting the apparatus.

The receptacle back member, the receptacle front member, and the cover member are of molded plastic construction, the receptacle front member and the receptacle back member being integrally connected together by an integral hinge at the lower ends thereof.

The receptacle back member includes a back panel and plurality of side walls projecting from the back panel partially defining the receptacle interior. The side walls have smooth distal wall surfaces which are in partial registry with the opening defined by the receptacle front member when the receptacle front member is in its closed position.

Other features, advantages, and objects of the present invention will become apparent with reference to the following description and accompanying drawings.

BEST MODE FOR CARRYING OUT THE INVENTION

Figure 1:
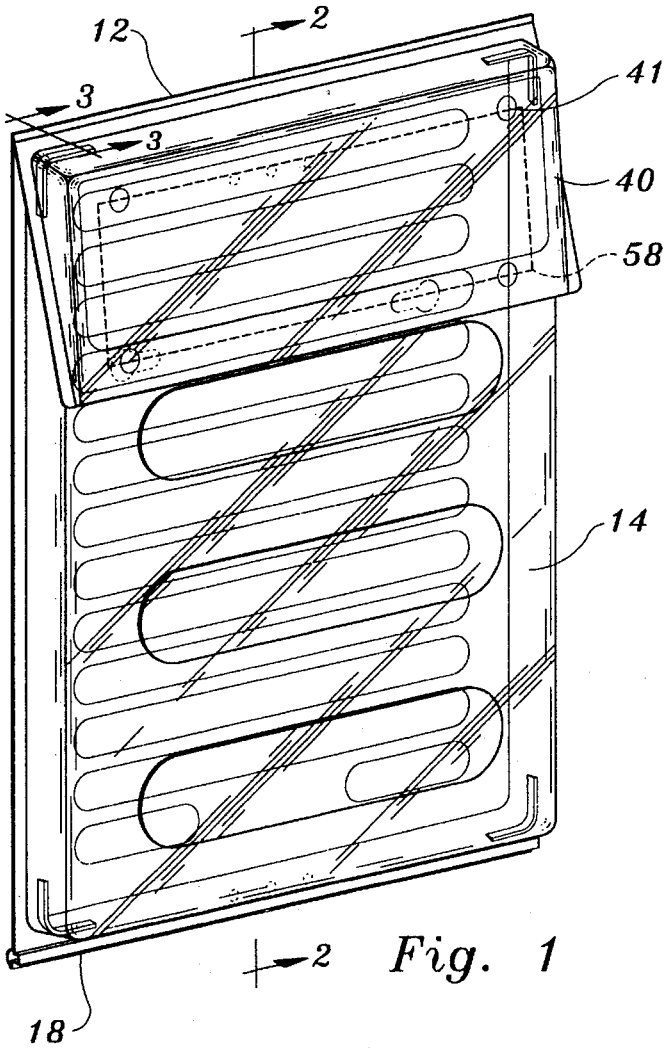
FIG. 1 is a perspective view of apparatus constructed in accordance with the teachings of the present invention in assembled condition.

Referring now to the drawings, apparatus constructed in accordance with the teachings of the present invention includes a receptacle back member 12 having upper and lower ends.

A receptacle front member 14 having upper and lower ends and defining an opening 16 at the upper end thereof is hingedly connected to the receptacle back member by an integral hinge 18. The back member, the front member and the hinge are integrally vacuum formed from a single sheet of transparent plastic material such as polyvinyl chloride. The receptacle front member 14 is movable between an open position shown in FIG. 5 to a closed position shown in FIG. 4, for example.

Receptacle back member 12 includes a back panel 20 and embossed walls projecting from the back panel. These walls include side walls 22 (FIG. 5), a top wall 24 and a bottom wall 26.

Figure 3:
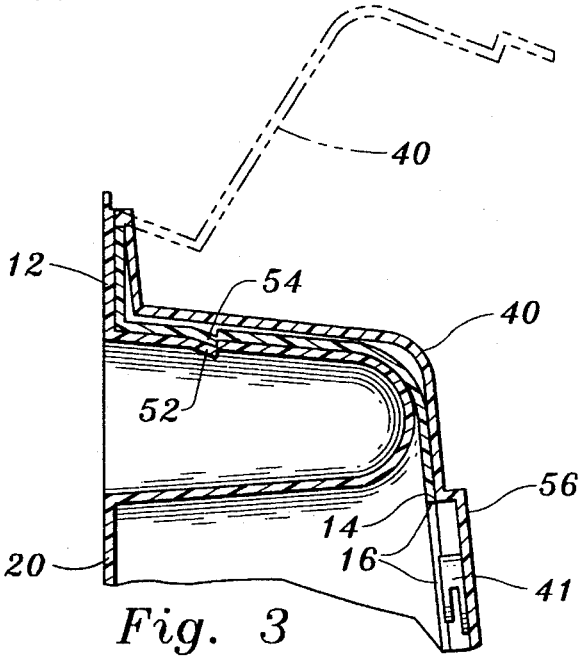
FIG. 3 is a greatly enlarged cross-sectional view of a portion of the apparatus taken along the line 3—3 in FIG. 1.

The walls 22, 24 and 26 are interconnected embossments having a hollow, channel-like cross section and smoothly curved, distal wall surfaces. The side, top and bottom walls are all of double-wall construction having an inner wall and an outer wall spaced from the inner wall. This may be seen, for example, with reference to top wall 24 in FIG. 3 wherein the inner wall is designated by reference numeral 25 and the outer wall is designated by reference numeral 27.

The receptacle back member also includes a plurality of spaced molded embossments 30 of generally rectangular configuration. These embossments along with embossed walls 22, 24 and 26 contribute to the strength and rigidity of the receptacle back member. Embossments 32 (see FIGS. 4 and 5) are formed in receptacle front member 14.

A cover member 40 suitably vacuum formed of plastic sheet material such as clear polyvinyl chloride is hingedly secured to the receptacle back member at the upper end of the receptacle back member. In the arrangement illustrated the cover member is RF welded to the receptacle back member, however any suitable expedient such as adhesive may be utilized for such purpose. Alternatively, the cover member may be formed integrally with the receptacle back member during the vacuum forming process.

Figure 2:
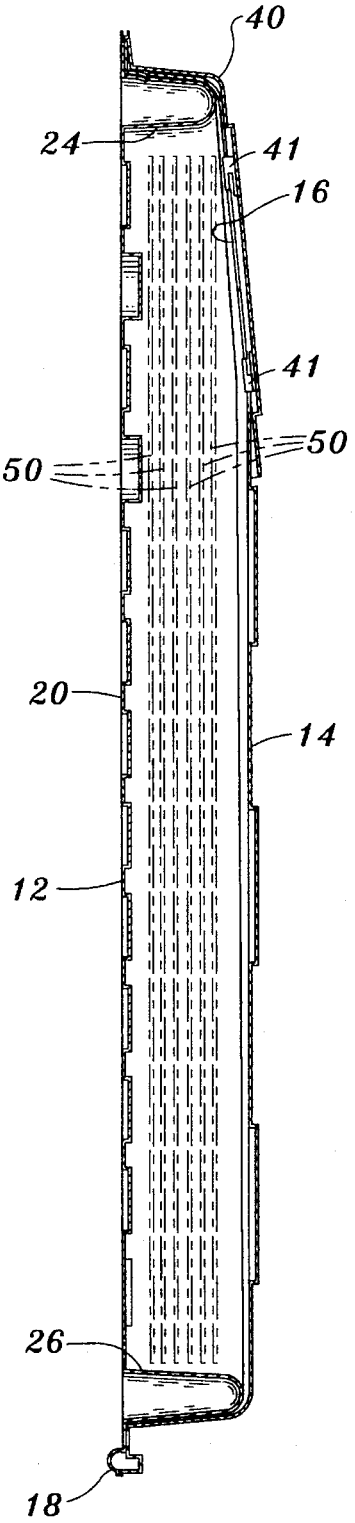
FIG. 2 is an enlarged cross-sectional view taken along the line 2—2 in FIG. 1.
Figure 4:
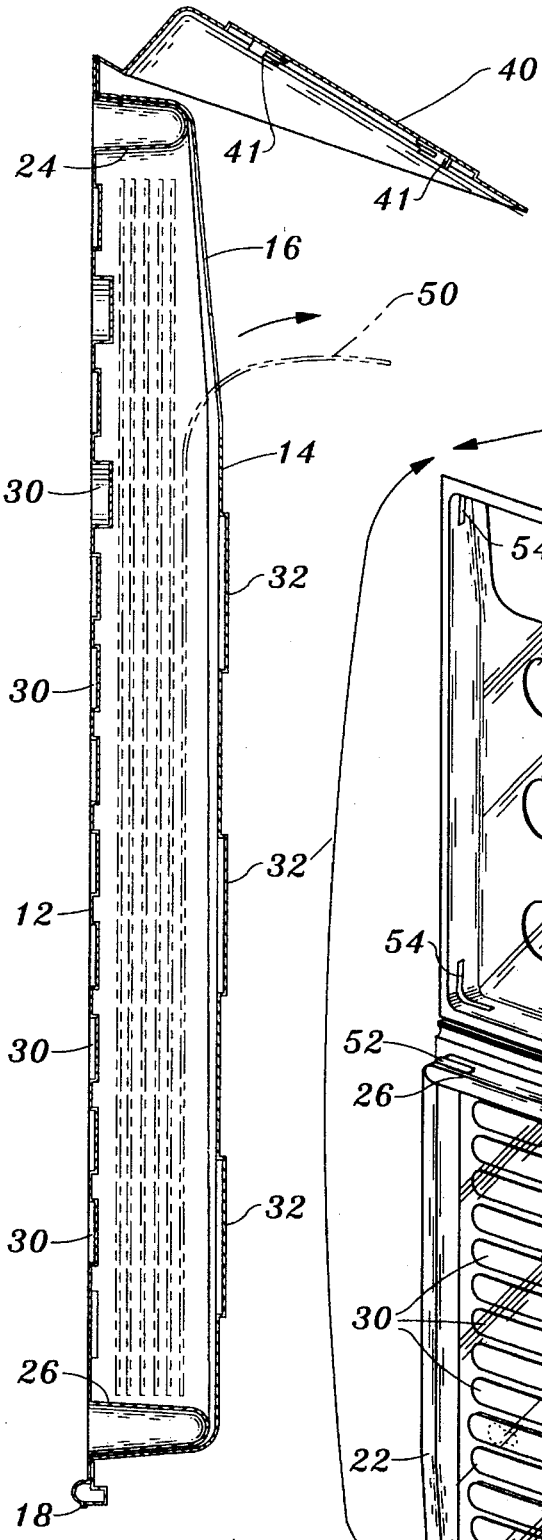
FIG. 4 is a view similar to FIG. 3 but illustrating the apparatus cover member in open position and a flyer shown in phantom being removed from a supply of flyers (also shown in phantom) within the apparatus.
Figure 5:
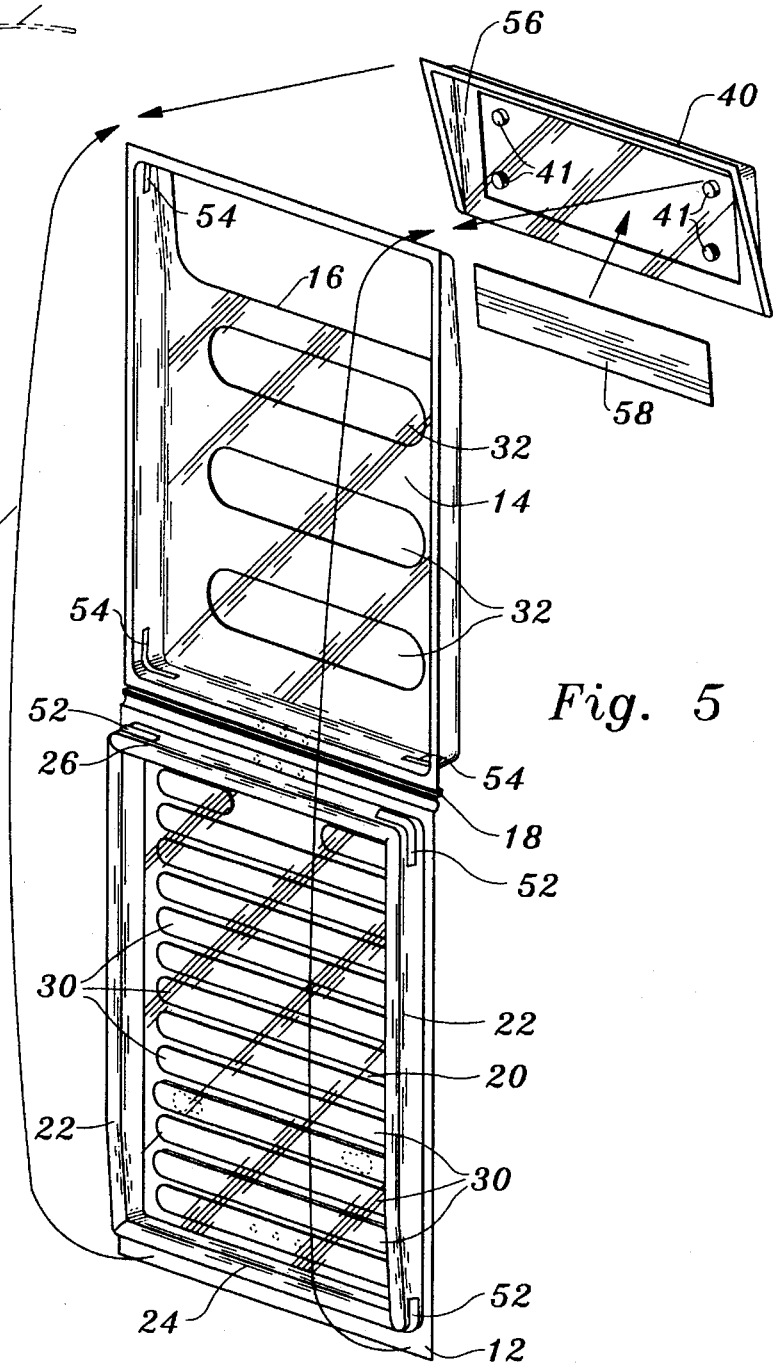
FIG. 5 is a perspective view illustrating the apparatus in unassembled condition and diagrammatically illustrating the interrelationship of structural components prior to assembly.
Figure 6:
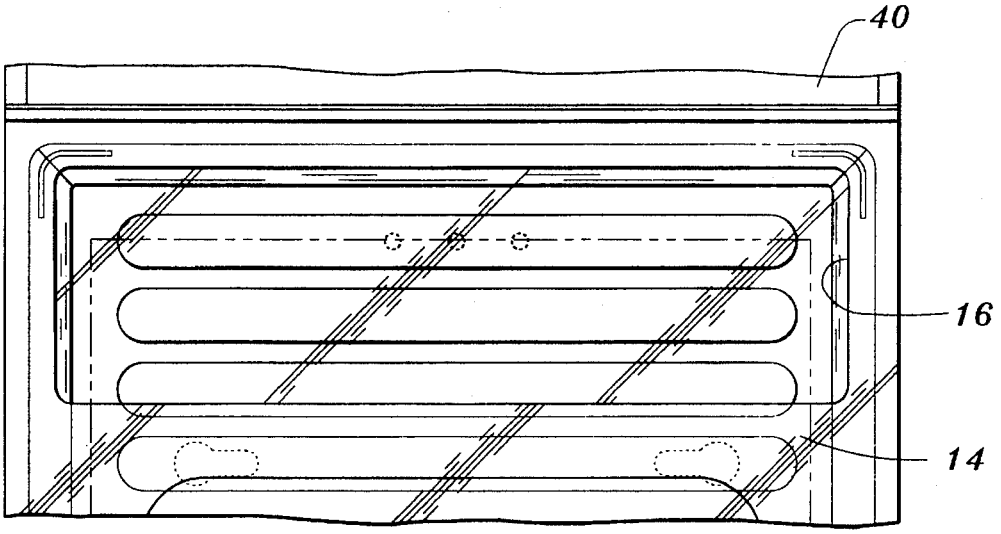
FIG. 6 is a partial front elevation view illustrating a portion of the cover member with the cover member raised to uncover an opening in the apparatus to facilitate flyer removal.
Figure 8:
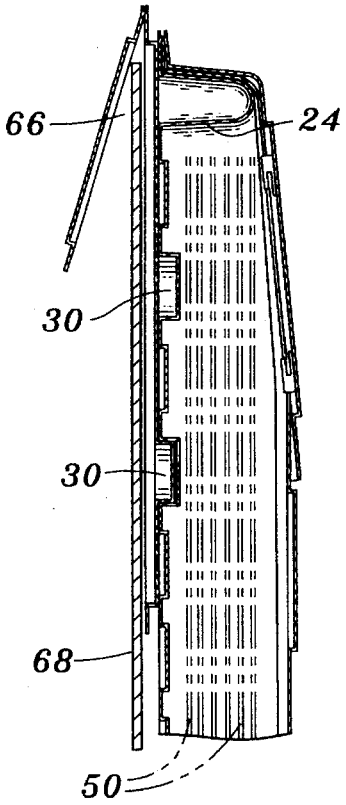
FIG. 8 is a partial sectional view with the support of FIG. 7 installed in position and supporting the apparatus.

The apparatus is for holding and dispensing flat articles such as flyers 50 shown in phantom in FIGS. 2, 4 and 8. In operation, the flyers 50 are positioned within the confines of walls 22, 24 and 26 of the receptacle back member when the receptacle front member is in open position. The flyers are placed on end on bottom wall 26 and are supported thereby.

The receptacle front member 14 is then manually moved from its open position to its closed position over the receptacle back member so that the receptacle back member and the receptacle front member define a receptacle interior accommodating the flyers. The cover member 40 must be temporarily lifted to its phantom line position shown in FIG. 3 to allow the receptacle front member to be positioned in place over the receptacle back member. The outer peripheral walls of the receptacle front member generally conform to the shape of and overlie the outer walls of side walls 22, top wall 24 and bottom wall 26. After the receptacle front member has been positioned, the hingedly attached cover member 40 is allowed to fall so that it covers opening 16. Such an arrangement provides a stable and relatively rigid structure since the peripheral walls of the receptacle back member and receptacle front member combine to form a composite outer wall of three-ply thickness.

Latch means is provided for releasably latching the receptacle front member to the receptacle back member with the receptacle front member in closed position. More particularly, indents 52 are formed at the four corners of the receptacle back member which receive four corresponding projections 54 at the corners of the receptacle front member. The cover member itself also serves to resist movement of the receptacle front member away from the receptacle back member when the receptacle front member is in its closed position when the cover member covers the opening 16.

Cover member 40 includes a transparent cover panel 56 for releasably receiving a card 58 bearing information so that the information is observable through the transparent cover panel from the outside thereof. Notched projections 41 can be utilized to receive and hold the card edges.

The horizontal dimension of the apparatus opening 16 is larger than the distance between receptacle back member side walls 22 so that the side walls project inwardly of the opening. In addition, the top wall 24 projects below the upper level of the opening. Such an arrangement facilitates removal of flyers and other flat articles from the apparatus by ensuring that they will not snag on the receptacle front member at the opening. The smoothly rounded character of the walls furthers this objective.

Figure 7:
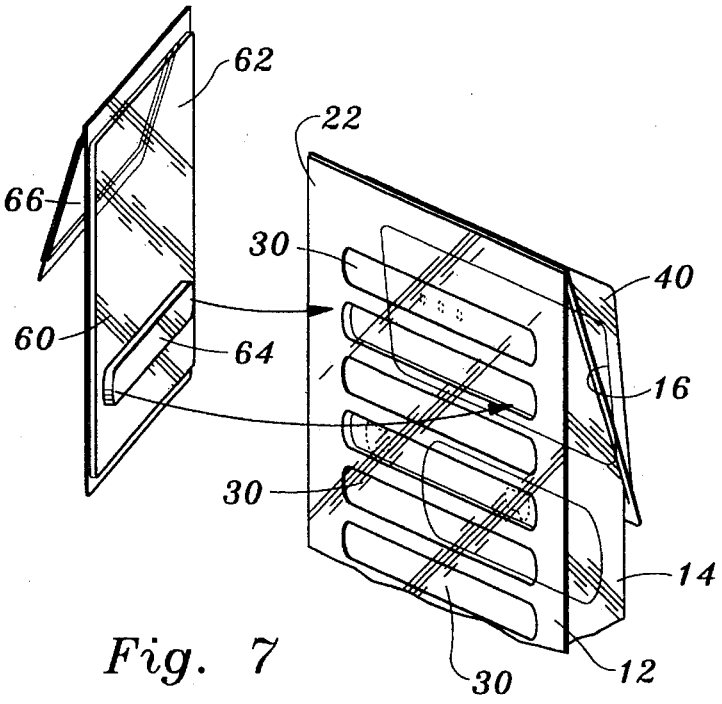
FIG. 7 is a partial perspective view illustrating installation of one form of support employed in the apparatus.

It is desirable to provide some means for supporting the apparatus at a desired location. The present invention incorporates several forms of supports which may be utilized depending upon the circumstances. FIGS. 7 and 8 illustrate one form of support 60 which consists of a support panel 62 and a projection 64 extending from the support panel. Panel 62 is doubled over at the top thereof to form a niche 66.

Projection 64 is sized and configured to be friction-fit into the interior of one of the embossments 30 formed in the receptacle back member. This will attach the support 60 to the back member. The support 60 may now be utilized to support the apparatus. FIG. 8 illustrates a structural member 68 having the upper end thereof within niche 66 to provide such support. For example, the structural member could be a car window.

Figure 9:
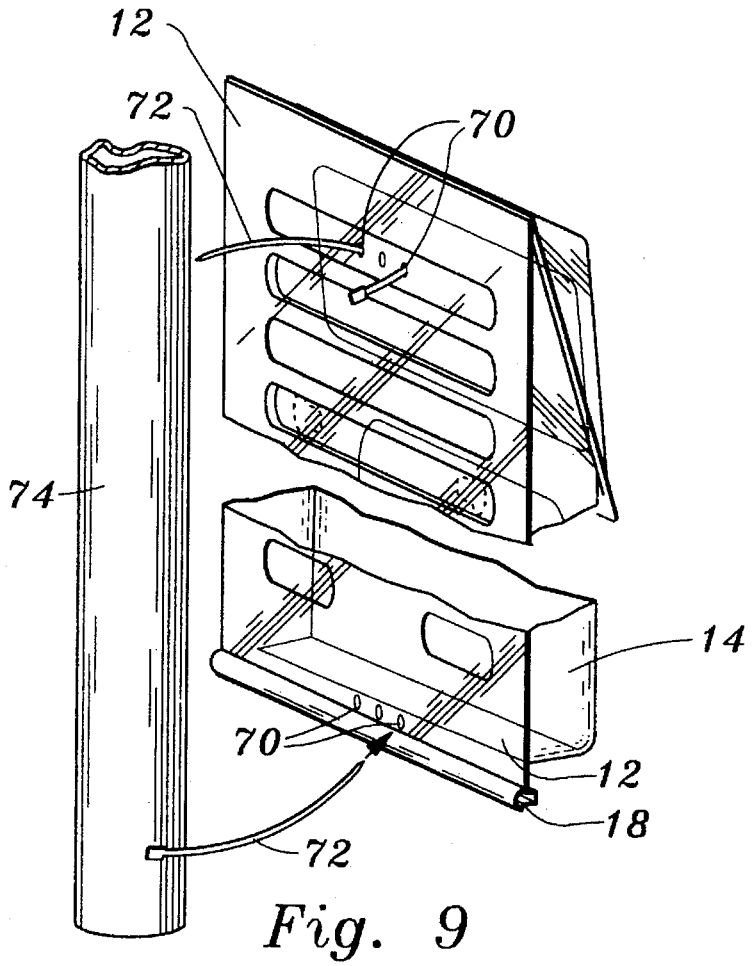
FIG. 9 is a perspective view of the apparatus with another form of support utilized to secure the apparatus to a pole.

FIG. 9 illustrates another form of support which may be utilized to support the apparatus. Holes 70 are formed in the receptacle back member to receive and accommodate therein flexible ties 72. Ties 72 can be utilized to secure the apparatus to an object such as post 74.

Figure 10:
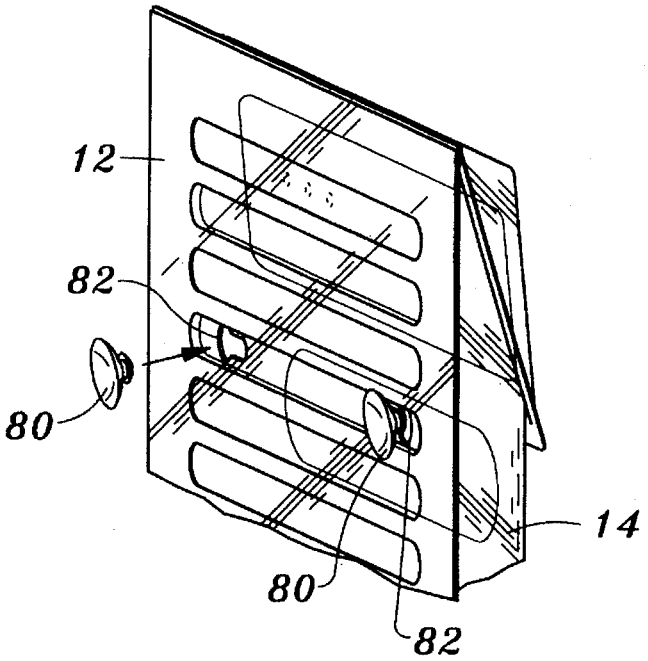
FIG. 10 is a partial perspective view illustrating yet another form of support which may be utilized to mount the apparatus.

In FIG. 10 two vacuum cups 80 are positioned in holes 82 in the receptacle back member. Such an arrangement may be utilized, for example, to secure the apparatus to a flat non-porous surface such as a window.

We claim:

1. Apparatus for holding and dispensing flat articles, said apparatus comprising, in combination:

a receptacle back member having upper and lower ends;

a receptacle front member having upper and lower ends and defining an opening at the upper end thereof, said receptacle front member connectable to said receptacle back member and movable between an open position and a closed position relative to said receptacle back member, said receptacle back member and said receptacle front member defining a receptacle interior for accommodating a plurality of flat articles when said receptacle front member is in said closed position;

latch means for releasably latching said receptacle front member to said receptacle back member with said receptacle front member in said closed position;

a cover member hingedly secured to said receptacle back member at the upper end of the receptacle back member and movable between a first position wherein said cover member covers the opening defined by said receptacle front member and resists movement of said receptacle front member away from said receptacle back member when said receptacle front member is in said closed position and a second position wherein said cover member exposes said opening allowing manual access to flat articles in said receptacle interior and allows movement of said receptacle front member away from said receptacle back member; and support means for supporting said apparatus said receptacle back member including a back panel and a plurality of side walls projecting from said back panel partially defining said receptacle interior, said side walls having smooth distal wall surfaces which are in partial registry with the opening defined by the receptacle front member when said receptacle front member is in said closed position, and said receptacle back member additionally including a top wall projecting from said back panel partially defining said receptacle interior, said top wall having a smooth distal wall surface in partial registry with the opening defined by the receptacle front member when said receptacle front member is in said closed position.

2. The apparatus according to claim 1 wherein said receptacle back member, said receptacle front member, and said cover member are of molded plastic construction, said receptacle back member and said receptacle front member being integrally connected together by an integral hinge at the lower ends thereof.

3. The apparatus according to claim 2 wherein said receptacle back member, said receptacle front member and said cover member are vacuum formed from plastic sheet material.

4. The apparatus according to claim 3 wherein said plastic sheet material is transparent.

5. The apparatus according to claim 1 wherein said side walls and said top wall are interconnected embossments having a hollow cross section and smoothly curved, distal wall surfaces.

6. The apparatus according to claim 1 wherein said cover member includes a transparent cover panel for receiving a card bearing information in the inside of said cover member with the information observable through said transparent cover panel.

7. The apparatus according to claim 1 wherein said cover member is of molded plastic construction and includes an integral cover hinge member affixed to said receptacle back member.

8. The apparatus according to claim 1 wherein said receptacle back member and said receptacle front member are of molded plastic construction and include molded embossments adding to the strength and stability of said receptacle back member and said receptacle front member.

9. The apparatus according to claim 1 wherein said receptacle back member is of molded plastic construction and includes at least one molded embossment defining an embossment interior and wherein said support means comprises a support member having a projection selectively positionable within said embossment interior, said projection being in frictional engagement with said molded embossment when said projection is positioned within the embossment interior to connect said support member to said receptacle back member.

10. The apparatus according to claim 1 wherein said receptacle back member includes a back panel defining a plurality of holes at spaced locations thereon, said support means including a plurality of supports selectively positionable in said holes to connect said supports to said back panel.

11. Apparatus for holding and dispensing flat articles, said apparatus comprising, in combination:

a receptacle back member having upper and lower ends;

a receptacle front member having upper and lower ends and defining an opening at the upper end thereof, said receptacle front member connectable to said receptacle back member and movable between an open position and a closed position relative to said receptacle back member, said receptacle back member and said receptacle front member defining a receptacle interior for accommodating a plurality of flat articles when said receptacle front member is in said closed position;

latch means for releasably latching said receptacle front member to said receptacle back member with said receptacle front member in said closed position;

a cover member hingedly secured to said receptacle back member at the upper end of the receptacle back member and movable between a first position wherein said cover member covers the opening defined by said receptacle front member and resists movement of said receptacle front member away from said receptacle back member when said receptacle front member is in said closed position and a second position wherein said cover member exposes said opening allowing manual access to flat articles in said receptacle interior and allows movement of said receptacle front member away from said receptacle back member; and support means for supporting said apparatus, said receptacle back member including a back panel and two side walls, a top wall and a bottom wall projecting from said back panel, each of said walls having an inner wall partially defining said receptacle interior and an outer wall spaced from said inner wall, said receptacle front member having a peripherally extended wall in engagement with the outer walls of said receptacle back member when said receptacle front member is in said closed position.

* * * * *